US008079218B2

(12) United States Patent
Widener

(10) Patent No.: US 8,079,218 B2
(45) Date of Patent: Dec. 20, 2011

(54) METHOD AND APPARATUS FOR COMBUSTOR NOZZLE WITH FLAMEHOLDING PROTECTION

(75) Inventor: Stanley Kevin Widener, Greenville, SC (US)

(73) Assignee: General Electric Company, Schenectady, NY (US)

( * ) Notice: Subject to any disclaimer, the term of this patent is extended or adjusted under 35 U.S.C. 154(b) by 453 days.

(21) Appl. No.: 12/469,910

(22) Filed: May 21, 2009

(65) Prior Publication Data

US 2010/0293954 A1 Nov. 25, 2010

(51) Int. Cl.
*F02C 1/00* (2006.01)
*F02G 3/00* (2006.01)

(52) U.S. Cl. ..... 60/742; 60/776; 60/740; 60/737

(58) Field of Classification Search ..... 60/737, 60/740, 741, 742, 748, 749, 772, 776; 239/533.2
See application file for complete search history.

(56) References Cited

U.S. PATENT DOCUMENTS 4,070,826 A * 1/1978 Stenger et al. ..... 60/748
4,292,801 A 10/1981 Wilkes et al.
4,850,194 A * 7/1989 Fuglistaller et al. ..... 60/737
5,259,184 A * 11/1993 Borkowicz et al. ..... 60/39.55
5,327,718 A 7/1994 Iwata et al.
5,361,586 A 11/1994 McWhirter et al.
5,685,139 A 11/1997 Mick et al.
5,857,320 A 1/1999 Amos et al.
5,961,314 A 10/1999 Myhre et al.
6,003,296 A 12/1999 Citeno et al.
6,158,223 A 12/2000 Mandai et al.
6,357,216 B1 3/2002 Scott et al.
6,530,207 B2 3/2003 Tobo et al.
6,698,207 B1 * 3/2004 Wiebe et al. ..... 60/737
6,786,046 B2 * 9/2004 Wiebe et al. ..... 60/737
7,412,833 B2 * 8/2008 Widener ..... 60/772
7,546,735 B2 * 6/2009 Widener ..... 60/746
7,694,521 B2 * 4/2010 Ohta et al. ..... 60/748

* cited by examiner

*Primary Examiner* — William H Rodriguez
(74) *Attorney, Agent, or Firm* — Dority & Manning, P.A.

(57) ABSTRACT

The structure and operation of a fuel nozzle for a gas turbine combustor is disclosed where the fuel nozzle provides for flameholding protection and, more specifically, to such a nozzle that provides for nondestructive protection from flameholding. The nozzle provides for differential thermal expansion between tubes forming fuel passages to allowing for the nondestructive venting of fuel during a flameholding condition. Upon extinguishing the flameholding condition, the nozzle returns to normal operating condition.

18 Claims, 4 Drawing Sheets

METHOD AND APPARATUS FOR COMBUSTOR NOZZLE WITH FLAMEHOLDING PROTECTION

FIELD OF THE INVENTION

The field of the invention disclosed herein relates generally to the structure and operation of a fuel nozzle in a gas turbine combustor that provides for flameholding protection and, more specifically, to such a fuel nozzle that provides for nondestructive protection from flameholding.

BACKGROUND OF THE INVENTION

By way of background, a gas turbine combustor is essentially a device used for mixing large quantities of fuel and air and burning the resulting mixture. Typically, the gas turbine compressor pressurizes inlet air, which is then turned in direction or reverse flowed to the combustor where it is used to cool the combustor and also to provide air to the combustion process. The assignee of this invention utilizes multiple combustion chamber assemblies in its heavy duty gas turbines to achieve reliable and efficient turbine operation. Each combustion chamber assembly comprises a cylindrical combustor, a fuel injection system, and a transition piece that guides the flow of the hot gas from the combustor to the inlet of the turbine section. Gas turbines for which the present fuel nozzle design is to be utilized may include six, ten, fourteen, or eighteen combustors arranged in a circular array about the turbine rotor axis.

In an effort to reduce the amount of $NO_x$ in the exhaust gas of the gas turbine, fuel nozzles have been developed that substantially premix air and fuel prior to the combustion flame, such that the temperature at the flame is reduced relative to conventional diffusion flames. Normal operation of these premixing fuel nozzles requires that a flame be prevented from forming within the premixing chamber. Moreover, the premixing fuel nozzles are designed to be able to eject and extinguish a flame that may inadvertently form in the premixing chamber due to momentary upset conditions owing to, e.g., a sudden transient in the gas turbine or a momentary change in fuel supply conditions.

Typically, the premixing chamber is not designed to endure the high temperatures encountered in the combustion chamber. However, a problem exists in that the combustor can be unintentionally operated so as to cause the flame to "flashback" from the burning chamber into the premixing chamber where the flame may continue to burn—a condition referred to as flameholding. Another problem that can lead to flameholding is the exposure of hydrogen or higher order hydrocarbons to gas turbines having premixing zones designed to normally run natural gas fuels. The presence of these components promotes flame speeds that are higher than methane and creates an environment where flashback is more possible and flameholding is more difficult to extinguish by the normal thermodynamics of a premixing zone designed to operate on methane. In either case, flashback and flameholding can each result in serious damage to combustor components from burning, as well as damage to the hot gas path of the turbine when burned combustor pads are liberated and passed through the turbine section.

U.S. Pat. No. 5,685,139 describes a premix nozzle that uses fuse regions near the discharge end of the nozzle to address flashback. In the event of a combustion flashback, these fuse regions burn through due to the higher temperatures experienced when the flame attaches to the nozzle's radial fuel injectors. The burn through allows fuel to substantially bypass the radial fuel injectors and thereby terminate the flameholding event. Any molten metal released into the combustor by reason of the rupturing fuse regions will be substantially vaporized in the combustion chamber without further damage to the combustor or hot gas path. Simultaneously, the combustor switches over from a premix burning mode to a diffusion burning mode until repairs can be effected. While the turbine will now operate with higher NOx emissions, it will nevertheless operate satisfactorily, with minimum damage to the combustor and no damage to the turbine itself.

BRIEF DESCRIPTION OF THE INVENTION

The present invention provides for an improved fuel nozzle structure and operation for flameholding protection. More specifically, the present invention provides for nondestructive protection from flameholding through a nozzle that, upon activation, operates to extinguish flameholding and then automatically returns to its original state without damage requiring repair to the nozzle or turbine. Additional aspects and advantages of the invention may be set forth in part in the following description, or may be apparent from the description, or may be learned through practice of the invention.

In one exemplary embodiment, a fuel nozzle for a gas turbine is provided that includes a nozzle body defining an exterior and an axial direction. The nozzle body also has a tip portion. An inner tube extends axially within the nozzle body and defines an inner passage. An intermediate tube extends axially within the nozzle body. The intermediate tube is concentrically arranged and radially spaced from the inner tube and defines an intermediate passage therebetween. An outer tube extends axially within the nozzle body. The outer tube is concentrically arranged and radially spaced from the intermediate tube and defines an outer passage therebetween. A plug is attached at the tip portion of the nozzle body. The plug defines a first port connected to the outer passage.

The outer tube also defines a second port connected to the exterior. The second port is located near the tip portion of the nozzle body at a position proximate to the first port such that during normal conditions the first port is closed by the outer tube while during flameholding conditions the outer tube slides relative to the plug so as to connect the second port with the first port and thereby connect the outer passage to the exterior of the nozzle body. As such, fuel from the outer passage can be vented in a non-destructive manner to the exterior of the nozzle during a flameholding condition.

In another exemplary aspect of the present invention, a method of protecting a fuel nozzle of a gas turbine during flameholding conditions is provided. The fuel nozzle includes a nozzle body defining an exterior and a tip portion, an inner tube extending axially within the nozzle body and defining an inner passage, an intermediate tube extending axially within the nozzle body and defining an intermediate passage with the inner tube, and an outer tube extending axially within the nozzle body and defining an outer passage with the intermediate tube. The exemplary method includes the steps of providing fuel into the outer passage, providing curtain air or purge air to the intermediate passage, sliding the outer tube along axially relative to the intermediate tube during a flameholding condition so as to vent at least part of the fuel to the exterior of the nozzle body near the tip portion, and extinguishing the flameholding condition.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
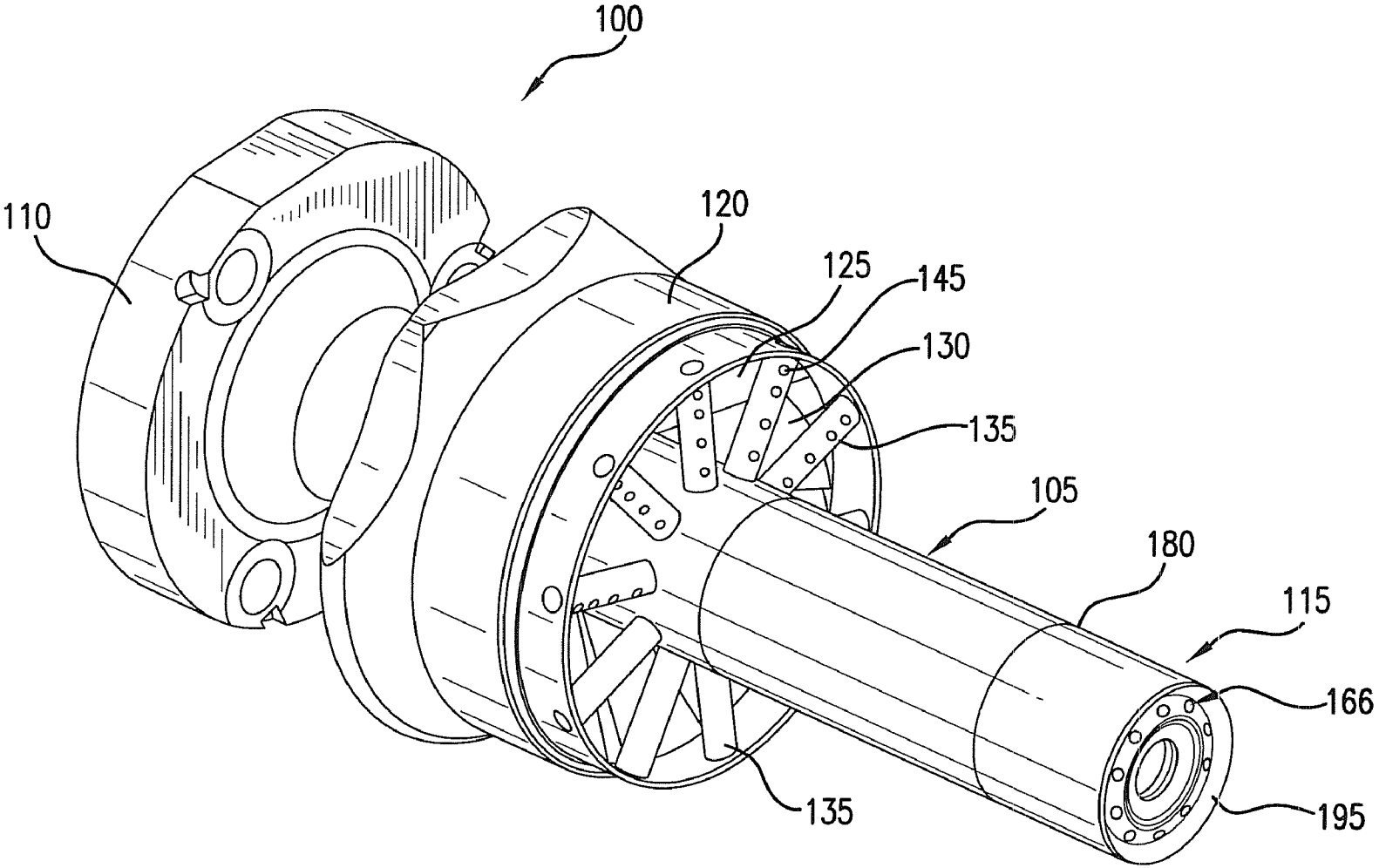
FIG. 1 (PRIOR ART)
FIG. 1 provides a perspective view of a known fuel nozzle for a gas turbine.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used with another embodiment to yield a still further embodiment. Thus, it is intended that the present invention covers such modifications and variations as come within the scope of the appended claims and their equivalents.

Figure 2:
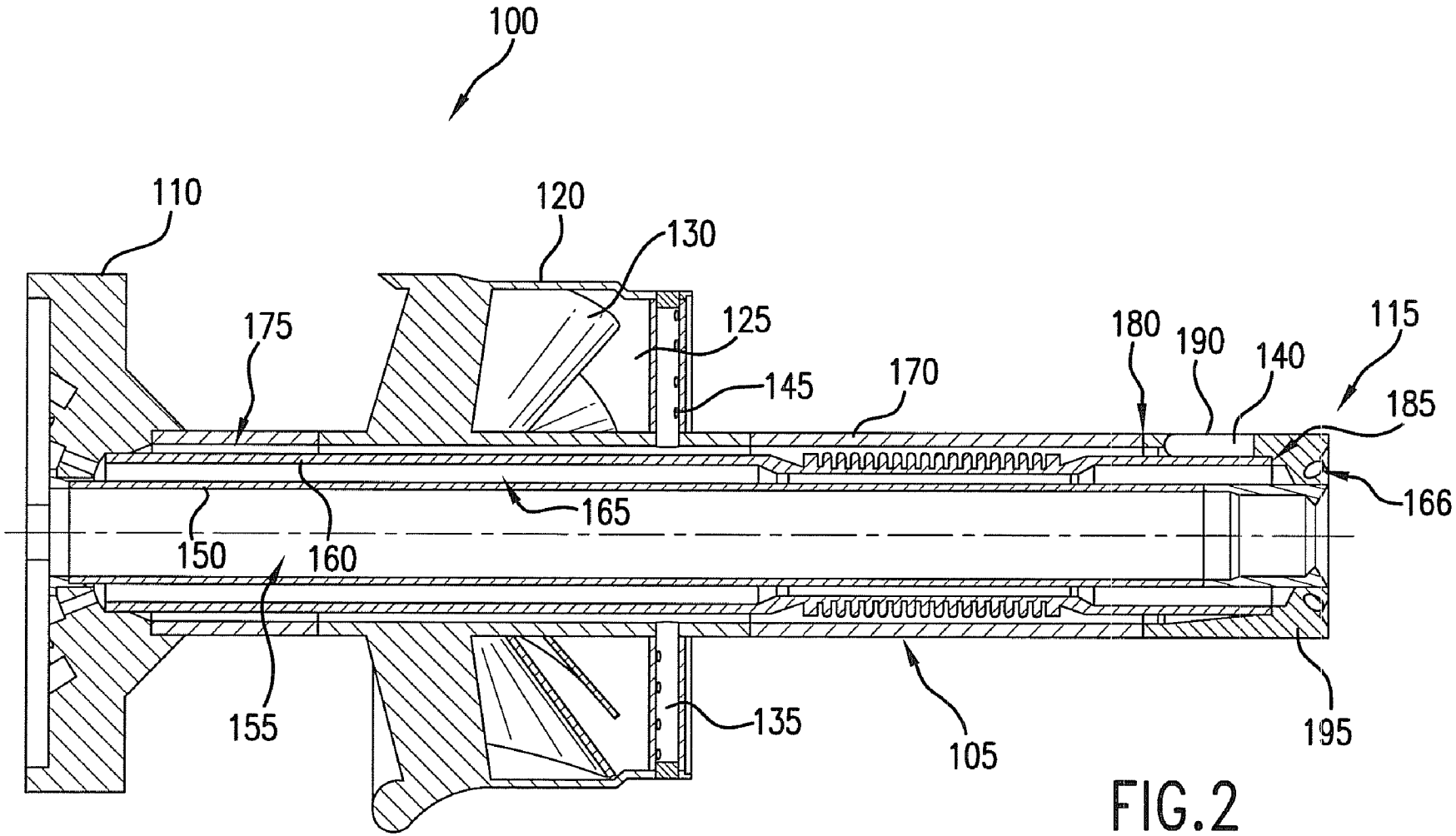
FIG. 2 (PRIOR ART)
FIG. 2 is a cross-sectional view of the fuel nozzle shown in FIG. 1.

FIG. 1 is a perspective view of a known fuel nozzle 100 and FIG. 2 is a cross-sectional view of fuel nozzle 100. Nozzle 100 includes a nozzle body 105 connected to a rearward supply section 110. At its tip portion, fuel nozzle 100 also includes a forward fuel/air delivery section at nozzle tip 115. Also included is a collar 120 that defines an annular passage 125 between the collar 120 and the nozzle body 105. Within this annular passage is an air swirler 130 upstream of a plurality of radial fuel injectors 135, each of which is formed with a plurality of discharge orifices 145 for discharging fuel such as a premix gas into passage 125 within the premix chamber of a combustor.

With specific reference to FIG. 2, fuel nozzle 100 includes an inner tube 150 that extends axially within nozzle body 105 and defines an inner passage 155. Inner passage 155 may, for example, feed air to the combustion zone or can be configured for receipt of a liquid fuel delivery cartridge. An intermediate tube 160 also extends axially within nozzle body 105. Intermediate tube 160 is positioned around the inner tube 150 in a concentric manner but with a larger diameter to create an intermediate passage 165. Intermediate passage 165 provides for the flow of e.g., diffusion gas, curtain air, or purge air through orifice 166. Similarly, an outer tube 170 extends axially along nozzle body 105. Outer tube 170 is positioned around the intermediate tube 160 in a concentric manner but with a larger diameter to create an outer passage 175. Outer passage 175 provides for carrying fuel such as a premix gas. During normal (non-flamehold) operation of fuel nozzle 100, fuel is forced to discharge from outer passage 175 by exiting through discharge orifices 145 in radial fuel injectors 135.

Still referring to the nozzle shown in FIGS. 1 and 2, nozzle 100 includes a plug 195 located at nozzle tip 115. Plug 195 is sized to engage the nozzle body 105 and is typically welded thereto at interface 180. Plug 195 is formed with an interior, annular shoulder 185 (FIG. 2) that receives the forward edge of intermediate tube 160, and which is welded or brazed at this forward edge. At or near shoulder 185 is also where the forward or downstream end of the intermediate passage 165 is closed.

As described in U.S. Pat. No. 5,685,139, the wall thickness of the plug 195 along the longitudinally-oriented cylindrical wall 190, which forms the forward or downstream part of the outer passage 175, is thinned at a plurality of fuse regions 140 (FIG. 2) that are spaced circumferentially about nozzle tip 115. In the event of a combustion flashback into the premix zone, one or more of the fuse regions 140 created by thinned walls 190 will burn through as a result of the higher temperature experienced at the fuse regions 140 when the flame attaches at the radial fuel injectors 135. The burn through allows fuel to substantially bypass radial fuel injectors 135 and exit directly into the combustion zone through the burned out wall area. While some fuel may continue to flow out of the radial fuel injectors 135, the flow will be insufficient to sustain a flame, thereby causing the flamehold to terminate. The combustor containing nozzle 100 will switch over from a premix burning mode to a diffusion burning mode until repairs to fuse regions 140 can be effected.

FIGS. 3 through 6 represent exemplary embodiments of nozzle tips 315, 415, 515, and 615 as may be used on nozzles that are the subject of the present invention. For example, these tips may be used on fuel nozzle 100 or a fuel nozzle of alternate construction instead of nozzle tip 115. Nozzle tips 315, 415, 515, and 615 are provided by way of example, and not limitation, of the present invention.

Figure 3:
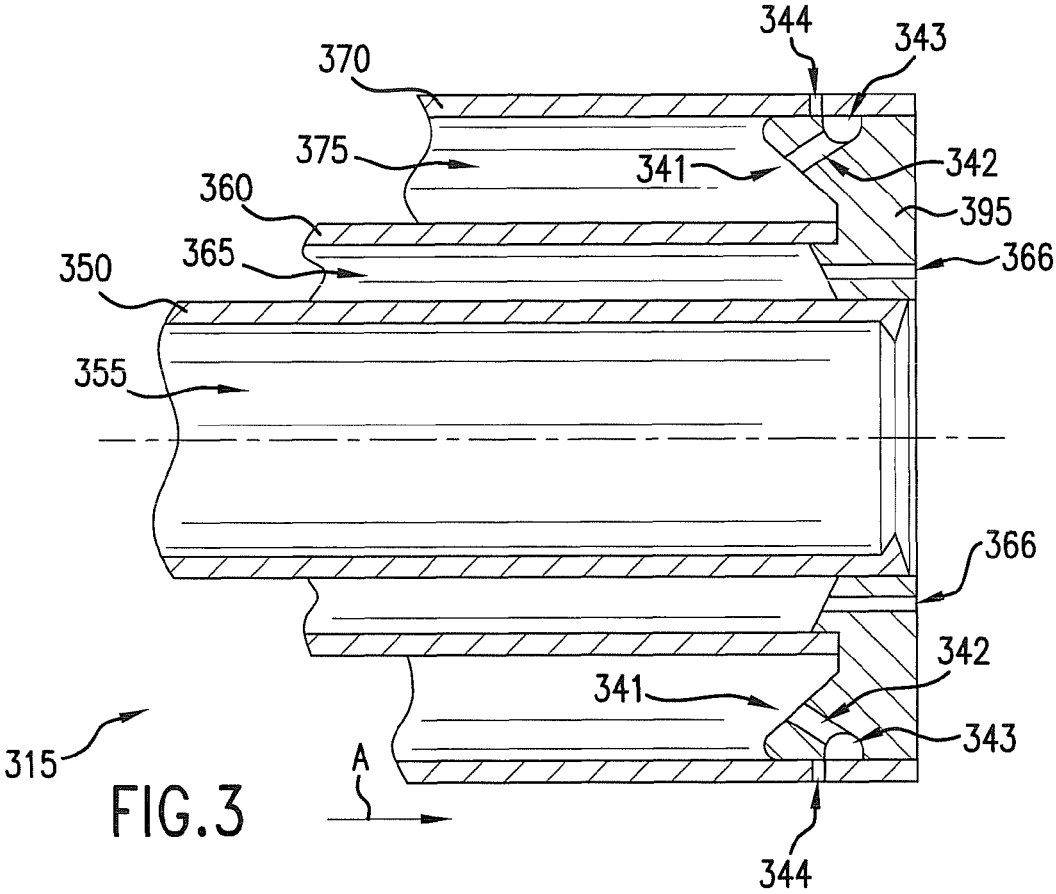
FIGS. 3 through 6 are cross-sectional views of exemplary embodiments of the tip portions of fuel nozzles constructed according to the subject matter of the present invention.

Referring now to FIG. 3, the plug 395 of nozzle tip 315 defines a first port 341 that connects to outer passage 375 containing fuel. First port 341 is created, for example, by a plurality of holes 342 located circumferentially about plug 395 and connected to an annular groove 343 machined into the radially outer surface of plug 395. In addition, holes 342 are at an angle to the longitudinal axis (i.e., axial direction) of fuel nozzle body 105. Outer tube 370 defines a second port 344 that connects to the exterior of the nozzle tip 315. As shown in FIG. 3, second port 344 is created, for example, by a plurality of holes or openings extending through the wall of outer tube 370 and positioned about the circumference of outer tube 370. Plug 395 defines a third port 366, which provides for the flow of e.g., diffusion gas, curtain air, or purge air to the exterior of nozzle tip 315. Third port 366 is created, for example, by a plurality of holes circumferentially spaced about plug 395.

Notably, plug 395 is attached to the intermediate tube 360 and may be attached to inner tube 350. However, plug 395 is not attached to outer tube 370, which is free to move or slide relative to plug 395 as shown by arrow A. The outer tube 370 and the intermediate tube 360 are fixed relative to each other at their upstream or forward ends at a position that may be upstream of or near the radial fuel injectors 135 (FIG. 1).

During a flameholding condition, the heat of a flame burning in the premixing zone adjacent to outer tube 370 will rapidly heat outer tube 370. For example, during normal operating conditions, outer tube 370 might reach a temperature of about 425° C. During flamehold conditions, the outer tube 370 can reach a temperature of about 815° C. as the flame temperature can reach as high as about 1650° C. However, whether nozzle tip 315 is experiencing normal or flamehold conditions, the temperature of intermediate tube 360 will remain relatively constant and at about the same temperature as the fuel in outer passage 375 (e.g., about 200° C.).

Accordingly, during a flamehold condition, outer tube 370 will experience a thermal expansion along the axial direction as shown by arrow A in FIG. 3 while intermediate tube 360 will experience either no expansion or much less than that experienced by outer tube 370. Because plug 395 is fixed to intermediate tube 360, this differential thermal growth will cause outer tube 370 to slide in the direction of arrow A relative to intermediate tube 360 and plug 395. As a result, second port 344 in outer tube 370 will connect with the first port 341 in plug 395 and thereby connect the outer passage 375 to the exterior of nozzle body 105. Fuel in outer passage 375 will now vent to the exterior of the fuel nozzle 100 and thereby reduce the flow of fuel that normally flows from the outer passage 375, through radial fuel injectors 135, and then out through discharge orifices 145 (FIG. 1).

The sizing of the effective cross-sectional flow area for the first and second ports 341 and 344 is such that the reduction of fuel flowing from discharge orifices 145 will starve the flame within the premix chamber adjacent to the nozzle body 105 and thereby extinguish the flameholding condition. For example, the effective cross-sectional flow area when the first and second ports 341 and 344 are aligned could be sized to a magnitude similar to the flow area from discharge orifices 145. In such case, during a flame holding condition, the quantity of fuel flowing from discharge orifices 145 would be about half the amount flowing during normal operation. This reduction should be sufficient to extinguish the flameholding condition.

Consequently, upon extinguishing the flameholding condition, outer tube 370 will begin to cool and return to its original size and position. More specifically, as outer tube 370 cools it will slide along the axial direction in manner opposite to that shown by arrow A. As a result, first port 341 and second port 344 will eventually be disconnected as the nozzle tip 315 returns its normal conditions of operation. The flow of fuel to discharge orifices 145 will then be restored to its original operating flow. Because the flameholding condition is extinguished before damage occurs, fuel nozzle 100 can now continue operation without requiring repair to nozzle tip 315 and can react to another flamehold condition if required. In addition, with nozzle tip 315, nozzle 100 is more capable of being used with natural gas fuel that may contain certain amounts of hydrogen or higher order hydrocarbons.

In order to increase the thermal responsiveness of nozzle tip 315 to flamehold conditions, the wall thickness of outer tube 370 can be reduced relative to that of the intermediate tube 360. Reducing the wall thickness will allow the outer tube 370 to heat more rapidly and thereby slide in the direction of arrow A more quickly upon a flameholding condition. As an alternative or in addition thereto, outer tube 370 can be constructed from a material having a coefficient of thermal expansion that is larger than the coefficient for the material used in construction of intermediate tube 360.

Figure 4:
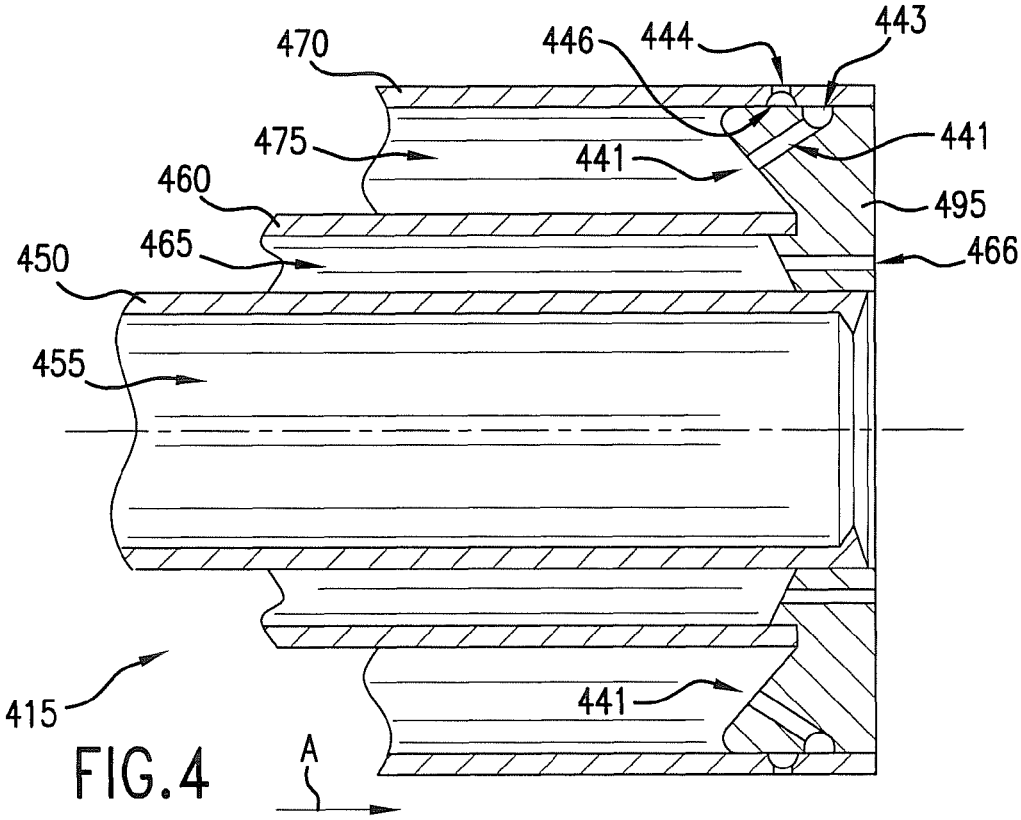

As stated previously, second port 344 can be constructed from a plurality of openings or holes positioned about the circumference of outer tube 370. FIG. 4 illustrates an alternative exemplary embodiment of the invention that may be used to reduce the number and increase the diameter of holes necessary to create second port 344. More specifically, nozzle tip 415 is constructed and operates in a manner similar to that of tip 315. However, outer tube 470 is provided with an annular groove 446 extending circumferentially about the radially-inner surface of outer tube 470. Annular groove 446 acts as a reservoir connecting each of the circumferentially-spaced holes that create second port 444 about the circumference of outer tube 470. The annular gap created between annular grooves 443 and 446 results in a larger area being opened to flow by the motion of outer tube 470 relative to plug 495 than may be feasible with the design shown in FIG. 3. As such, annular groove 446 allows more fuel to be vented from first port 441 into second port 444 while having a smaller number of holes of larger diameter located about the circumference of outer tube 470 than required with the exemplary embodiment of FIG. 3.

Figure 5:
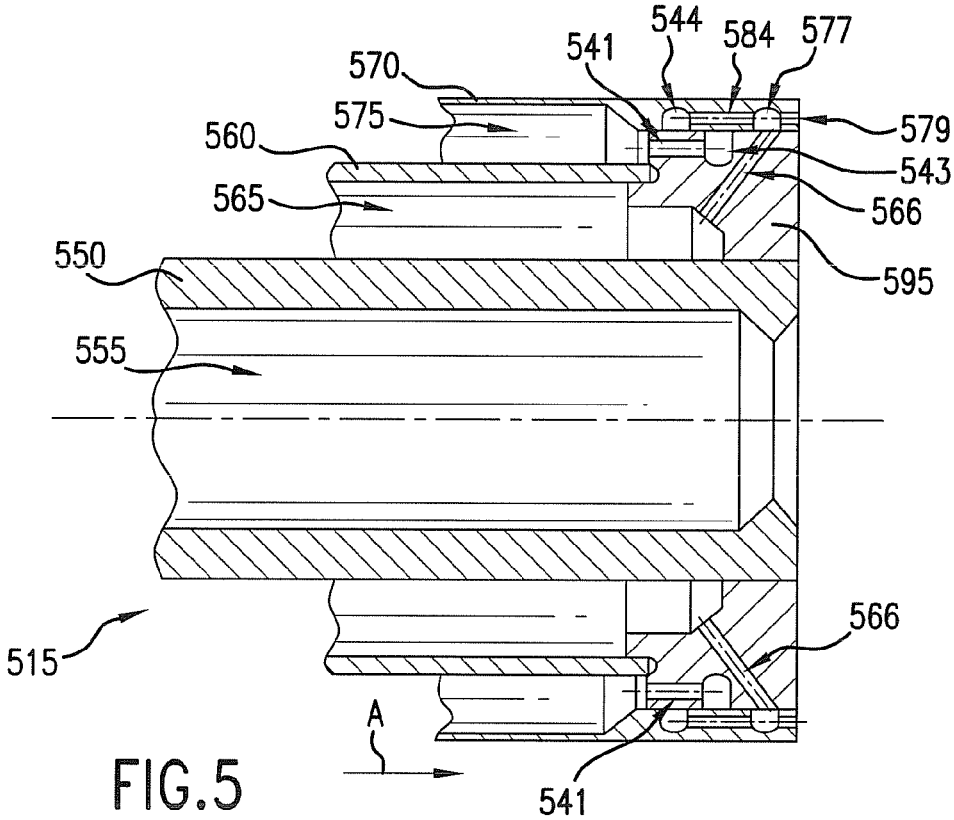

FIG. 5 provides another exemplary alternative embodiment of a nozzle tip 515. As with previous embodiments, outer tube 570 is configured to slide relative to plug 595, which is fixed to intermediate tube 560. Outer tube 570 defines a fourth port 577 located radially adjacent to plug 595. Fourth port 577 is created, for example, by an annular groove along the inside surface of outer tube 570 and a plurality of axial holes 579 that are circumferentially-spaced about the end of outer tube 570. Outer tube 570 also defines a second port 544 that connects to the exterior of fuel nozzle 100 by conduit 584, which is in turn connected to the annular groove of fourth port 577.

Plug 595 also defines a third port 566 connected to intermediate passage 565, which provides for the flow of e.g., curtain air, or purge air. However, unlike previous embodiments, third port 566 is at an angle with respect to the axial direction (i.e., longitudinal axis) of nozzle body 105. In addition, instead of connecting to the exterior of fuel nozzle 100, third port 566 connects intermediate passage 565 to the fourth port 577 to allow air flow to exit through the same. The fourth port 577 is positioned and sized so that regardless of the movement of the outer tube 570 relative to intermediate tube 560, connection with third port 566 is maintained to allow for the flow of air from intermediate passage 565 regardless of whether fuel nozzle 100 is operating normally or experiencing a flamehold condition.

Plug 515 also defines a first port 541 connected to the outer passage 575 containing fuel. First port 541 is created, for example, from a plurality of axially-oriented conduits connecting to an annular groove 543 that is machined into the radially-outer surface of plug 595.

During a flamehold condition, outer tube 570 will experience a thermal expansion along the axial direction as shown by arrow A while intermediate tube 560 will experience either no expansion or much less than that experienced by outer tube 570. Because plug 595 is fixed to intermediate tube 560, this differential thermal growth will cause outer tube 570 to slide in the direction of arrow A relative to intermediate tube 560 and plug 595. As a result, second port 544 in outer tube 570 will connect with the first port 541 in plug 595 and thereby connect the outer passage 575 to the exterior of nozzle body 105 via conduit 584 and fourth port 577. Fuel in outer passage 575 will now vent to the exterior of the fuel nozzle 100 and thereby reduce the flow of fuel through discharge orifices 145 (FIG. 1). However, before discharge to the exterior, the fuel will mix with air from third port 566 to help minimize $NO_x$ formation when the fuel is subsequently burned. The flow of air through third port 566 also helps to cool plug 595.

Once the flamehold condition is extinguished, outer tube 570 will begin to cool and return to its original size and position by sliding along the axial direction in manner opposite to that shown by arrow A. As a result, first port 541 and second port 544 will eventually be disconnected as the nozzle tip 515 returns to its normal conditions of operation. The flow of fuel to discharge orifices 145 will then be restored to its original operating flow. Because the flameholding condition is extinguished before damage occurs, fuel nozzle 100 can now continue operation without requiring repair to nozzle tip 515. In addition, as with previous embodiments nozzle tip 515 allows nozzle 100 to perform more desirably when natural gas containing hydrogen or higher order hydrocarbons is burned.

It should also be understood that because of the sliding fit between outer tube 570 and plug 595, a small leakage of fuel from first port 541 to second port 544 and/or fourth port 577 may occur during normal operating conditions. More specifically, even though first port 541 is disconnected from these other ports during normal operation, some fuel may leak through the movable interface between the outer tube 570 and plug 595. However, by arranging third port 566 to vent curtain or purge air into fourth port 577 as shown in FIG. 5, the formation of undesirable $NO_x$ will be minimized as the leaking fuel will be mixed with such air before combustion.

Figure 6:
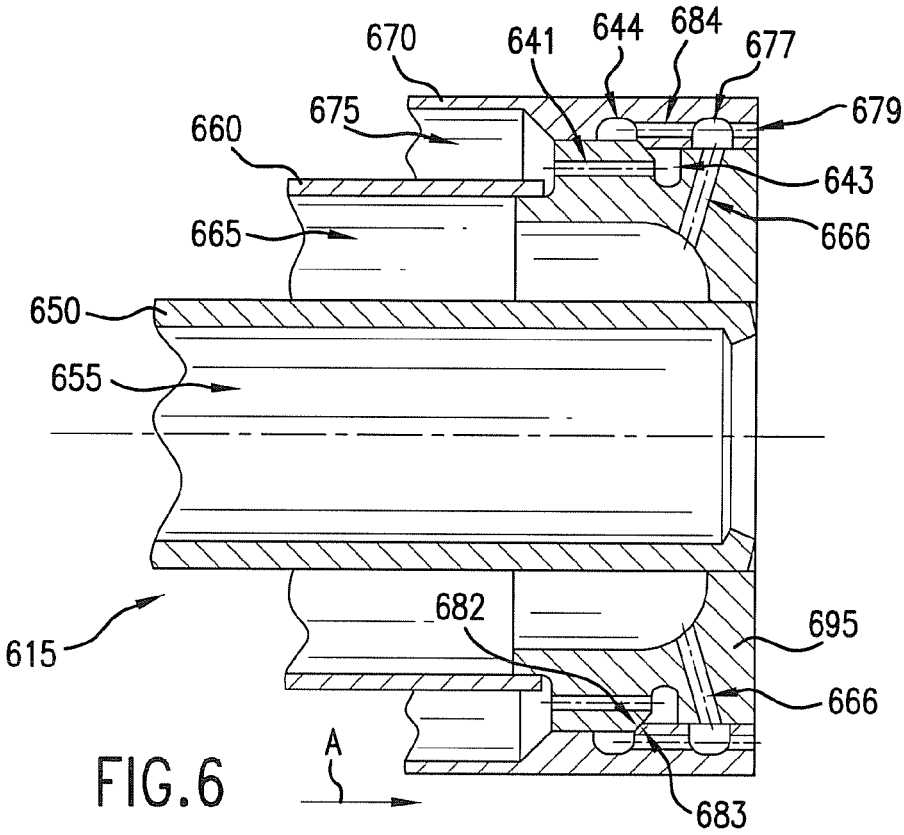

FIG. 6 illustrates another exemplary embodiment of the present invention with a structure and operation similar to that described for the embodiment of FIG. 5. However, nozzle tip 615 includes a pair of beveled edges 682 and 683 that are configured to meet during normal operation and separate during flamehold conditions. More specifically, plug 695 provides a beveled edge 682 adapted to meet with A complementary beveled edge 683 formed by outer tube 670. Movement of the outer tube 670 during flamehold operation will separate edges 682 and 683 so as to vent fuel from outer passage 675 and extinguish the flamehold condition as previously described. After extinguishment, edges 682 and 683 will return to the closed position shown in FIG. 6. Accordingly, the exemplary embodiment of FIG. 6 provides a "poppet style" valve seat to provide a positive closing force during normal operation conditions.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A fuel nozzle for a gas turbine comprising:

a nozzle body defining an exterior and an axial direction, said nozzle body also having a tip portion;

an inner tube extending axially within said nozzle body and defining an inner passage;

an intermediate tube extending axially within said nozzle body, said intermediate tube concentrically arranged and radially spaced from said inner tube and defining an intermediate passage therebetween;

an outer tube extending axially within said nozzle body, said outer tube concentrically arranged and radially spaced from said intermediate tube and defining an outer passage therebetween; and a plug attached to the tip portion of said nozzle body, said plug defining a first port connected to the outer passage;

wherein said outer tube defines a second port connected to the exterior, said second port located near the tip portion of said nozzle body at a position proximate to the first port such that during normal conditions the first port is closed by said outer tube while during flameholding conditions the outer tube slides relative to said plug so as to connect the second port with the first port and thereby connect the outer passage to the exterior of said nozzle body.

2. The fuel nozzle as in claim 1, wherein said plug further defines a third port located near the tip portion of said nozzle body, said third port connected to the intermediate passage so as to vent the intermediate passage to the exterior of said nozzle body.

3. The fuel nozzle as in claim 1, wherein said plug further defines a third port located near the tip portion of said nozzle body, said third port connected to the intermediate passage and positioned at an angle to the axial direction of said fuel nozzle body; and wherein said outer tube further defines a fourth port located near the tip portion of said nozzle body, said fourth port connected to the third port so as to vent the intermediate passage to the exterior of said nozzle body.

4. The fuel nozzle as in claim 1, wherein said outer tube has a greater coefficient of thermal expansion that said intermediate tube.

5. The fuel nozzle as in claim 1, wherein said outer tube has a reduced wall thickness relative to said intermediate tube.

6. The fuel nozzle as in claim 1, wherein the second port comprises an annular groove formed along an interior surface of said outer tube.

7. The fuel nozzle as in claim 6, wherein the fourth port also comprises an annular groove formed along the interior surface of said outer tube.

8. The fuel nozzle as in claim 7, wherein the second port and the fourth port are connected by an axially-oriented channel formed within said outer tube.

9. The fuel nozzle as in claim 1, where said outer tube and said inner tube form a pair of annular, beveled edges near the tip portion of said nozzle body, said pair of beveled edges configured to meet during normal conditions and separate during flameholding conditions.

10. A method of protecting a fuel nozzle of a gas turbine during flameholding conditions, the nozzle including a nozzle body defining an exterior and a tip portion, an inner tube extending axially within said nozzle body and defining an inner passage, an intermediate tube extending axially within the nozzle body and defining an intermediate passage with the inner tube, an outer tube extending axially within said nozzle body and defining an outer passage with the intermediate tube, the method comprising the steps of:

providing fuel into the outer passage;

providing curtain air or purge air to the intermediate passage;

sliding the outer tube along axially relative to the intermediate tube during a flameholding condition so as to vent at least part of the fuel to the exterior of the nozzle body near the tip portion; and extinguishing the flameholding condition.

11. The method of protecting a fuel nozzle of a gas turbine as in claim 10, further comprising the step of returning the outer tube to its original position after extinguishing the flameholding condition.

12. The method of protecting a fuel nozzle of a gas turbine as in claim 10, further comprising the step of leaking fuel from the outer passage to the exterior of the nozzle body near the tip portion during normal operation while simultaneously venting curtain air or purge air from the tip portion of the nozzle.

13. The method of protecting a fuel nozzle of a gas turbine as in claim 10, wherein said step of sliding the outer tube comprises heating the outer tube to a higher temperature than the intermediate tube so as to cause greater axial thermal expansion of the outer tube relative to the intermediate tube.

14. The method of protecting a fuel nozzle of a gas turbine as in claim 10, further comprising the step of choosing a material for the construction of the outer tube that has a greater coefficient of thermal expansion than the material used for the intermediate tube.

15. The method of protecting a fuel nozzle of a gas turbine as in claim 14, further comprising the step of providing an outer tube having a smaller wall thickness than the wall thickness of the intermediate tube.

16. The method of protecting a fuel nozzle of a gas turbine as in claim 10, further comprising the step of providing an outer tube having a smaller wall thickness than the wall thickness of the intermediate tube.

17. The method of protecting a fuel nozzle of a gas turbine as in claim 10, further comprising the step of mixing the fuel that is vented during said sliding step with the purge air or curtain air.

18. The method of protecting a fuel nozzle of a gas turbine as in claim 10, wherein said nozzle includes at least one radial fuel injector located upstream of the tip portion, the method further comprising the step of reducing the flow of fuel so the radial fuel injector during said sliding step.

* * * * *